US007216839B2

(12) United States Patent
Xiaoqiu

(10) Patent No.: US 7,216,839 B2
(45) Date of Patent: May 15, 2007

(54) WATER-INJECTION RACK BASE FOR MAST

(76) Inventor: Sun Xiaoqiu, No. 3 Building, Hongzhuang Industry Area, Xinzhuang Community, Wu Xing Avenue, Changzhou City, Jiangsu Province (CN) 213000

( * ) Notice: Subject to any disclaimer, the term of this patent is extended or adjusted under 35 U.S.C. 154(b) by 65 days.

(21) Appl. No.: 11/215,164

(22) Filed: Aug. 30, 2005

(65) Prior Publication Data

US 2007/0045498 A1 Mar. 1, 2007

(51) Int. Cl.
*A47B 91/00* (2006.01)

(52) U.S. Cl. ..... 248/346.2; 248/511; 248/519; 248/910

(58) Field of Classification Search ..... 248/346.01, 248/346.03, 346.02, 346.2, 511, 519, 910
See application file for complete search history.

(56) References Cited

U.S. PATENT DOCUMENTS 6,446,930 B1 * 9/2002 Li ..... 248/519
6,619,610 B1 * 9/2003 Genovese ..... 248/519
6,682,029 B1 * 1/2004 Dierkes ..... 248/165
6,889,953 B2 * 5/2005 Harbaugh ..... 248/519

* cited by examiner

*Primary Examiner*—Ramon O Ramirez
(74) *Attorney, Agent, or Firm*—Ohlandt, Greeley, Ruggiero & Perle, L.L.P.

(57) ABSTRACT

A water injection rack base for a mast is formed of two semi-bases connected together by hinges, at the top surfaces of the two semi-bases being provided 1-2 water injection holes, on the joint face of the two semi-bases and on the central position being provided semi-cylindrical concaves, thereby forming holes on the top surface for inserting a mast when the two semi-bases are pulled open. This invention is of foldable-type, when in use, it can be easily pulled open, without need of being connected by bolts. The water injection hole is concealed, thereby preventing dusts and litters from entering into the bases, and making this invention novel in appearance. This invention has water discharge holes with easy water discharge, thus reducing labour intensity for workers.

8 Claims, 3 Drawing Sheets

WATER-INJECTION RACK BASE FOR MAST

BACKGROUND OF THE INVENTION

1. Field of the Invention

This invention relates to members of a rack, specifically a water-injection rack base for a mast.

2. Description of the Prior Art

A water-injection rack comprises a base, a stay bar and a marker. The stay bar is inserted into a hole of the base, and the marker is connected to the stay bar. In order to keep the rack stable, the rack base needs a weight. Since the base is hollow, the cavity of the base needs to be injected with water. Due to its large volume, the water injected rack base for a mast is generally composed of four ¼ shells, which are independent from each other and can be joined together. On the ¼ shells are provided water injection holes and bracket holes. When in use each time, the ¼ shells need to be connected by bolts, thus bringing about an inconvenience to some extent.

SUMMARY OF THE INVENTION

The object of this invention is to provide a foldable water injected rack base for a mast with convenient use.

To achieve the above object, the base of this invention is formed of two semi-bases hinged together by hinges and having cavities, at the top surfaces of the two semi-bases being provided 1-2 water injection holes, on the joint face of the two semi-bases and on the central position being provided semi-cylindrical concaves, thereby forming holes on the top surface for inserting a mast when the two semi-bases are pulled open.

The above hinge is composed of two leaves and a spindle hinging the two leaves, the two leaves being connected to the bottom surfaces of the two semi-bases respectively, and the two semi-bases being able to rotate with respect to each other through hinges when their bottom surfaces are hinged together.

All the outer corners of the two semi-bases are recessed inward, and on the recesses are provided slabs, and on the slabs are provided bracket holes.

On said semi-bases each are provided water discharge holes.

The water discharge holes of each semi-base are located under the slabs at corners, and at the ports of the water discharge holes are provided covers.

On the top surfaces of the two semi-bases each are provided a protrusion. When the two bases are pulled open, the protrusions are connected on the top surface and around the mast hole is formed a low lying on which the water injection hole is located.

On the bottom surfaces of the two semi-bases each are provided a protrusion. When the two bases are pulled open, the protrusions are connected on the bottom surface and around the mast hole is formed a low lying on which a blind hole is provided for positioning lock plates.

On the top surfaces of the above semi-bases are provided two water injection holes, and on the bottom surfaces thereof are provided two blind holes for positioning lock plates.

The utility model has the following beneficial effects:

1. This invention is of foldable-type, when in use, it can be easily pulled open, without need of being connected by bolts, which is easy in use, convenient in packaging, transportation and storage.

2. On the top surfaces of the two semi-bases each are provided a protrusion. When the two bases are pulled open, the protrusions are connected on the top surface and around the mast hole is formed a low lying on which the water discharge hole is located. When in use, this invention can be covered with lock plates at the low lying to conceal the water injection holes, thereby either preventing dusts and litters from entering into the bases, or making this invention novel in appearance.

3. This invention has water discharge holes with easy water discharge, thus reducing labour intensity for workers in water discharge.

DETAILED DESCRIPTION OF THE PREFERRED EMBODIMENT

Examples

Figure 1:
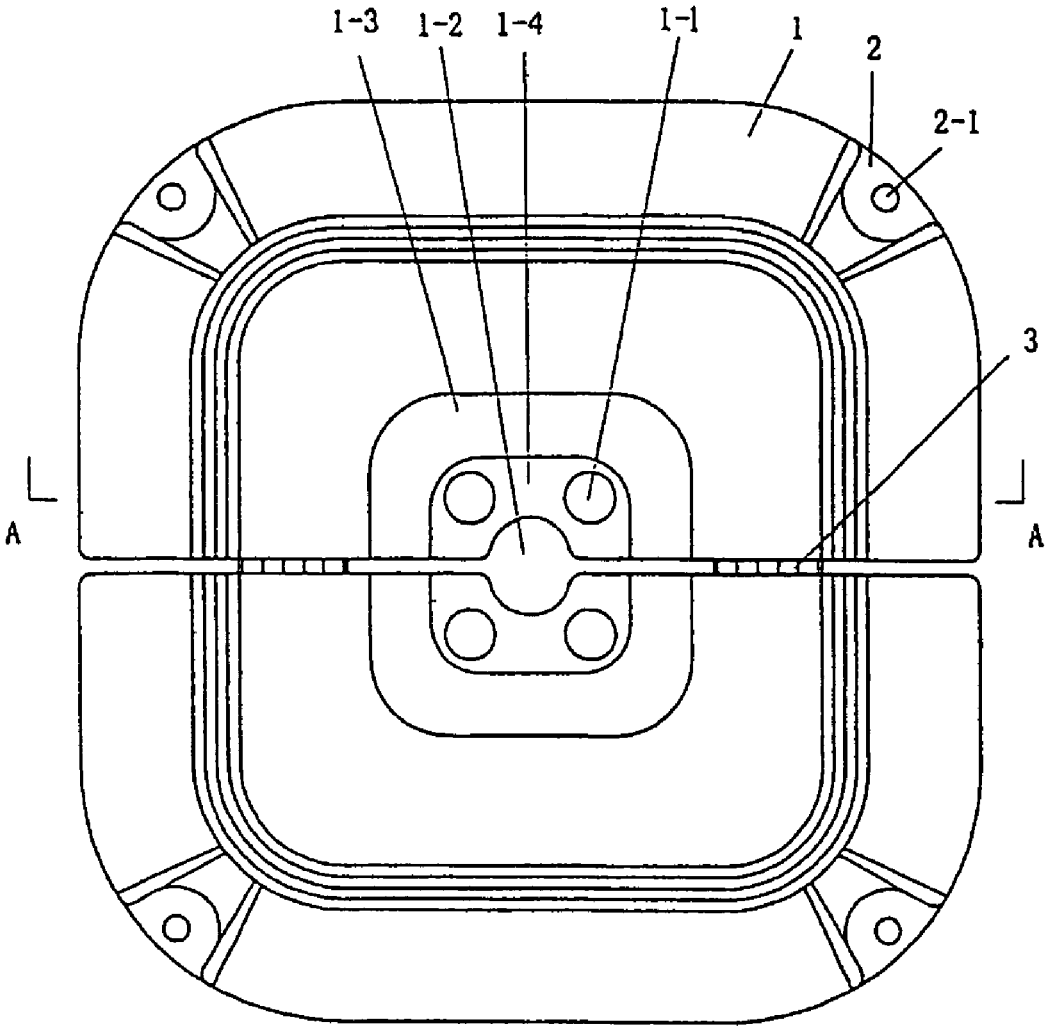
FIG. 1 is a structural view of this invention.
Figure 2:
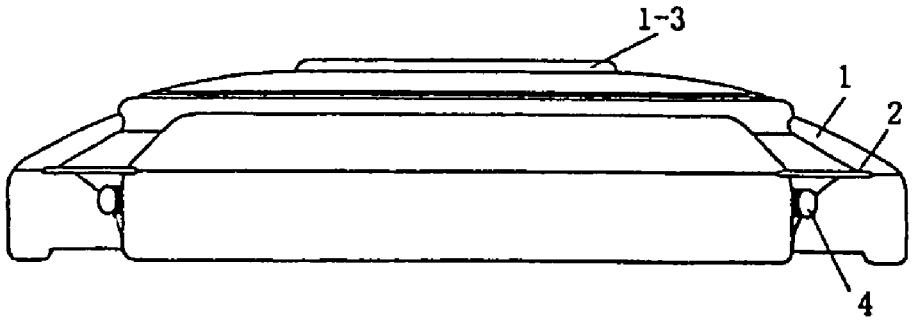
FIG. 2 is a plan view of FIG. 1.
Figure 3:
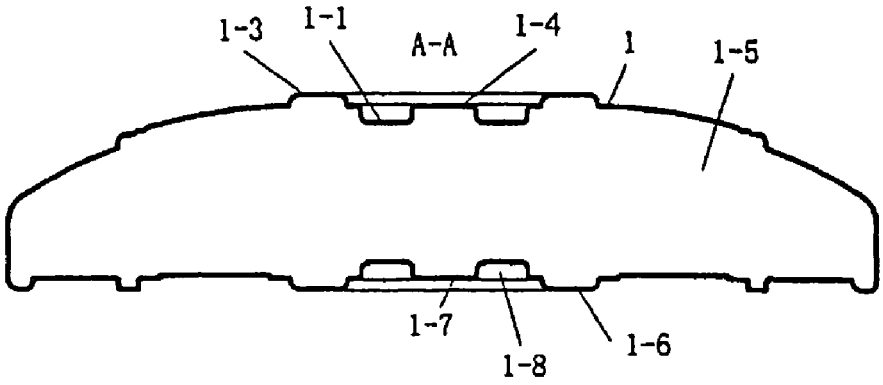
FIG. 3 is a cross-sectional view of FIG. 1 along A—A.
Figure 4:
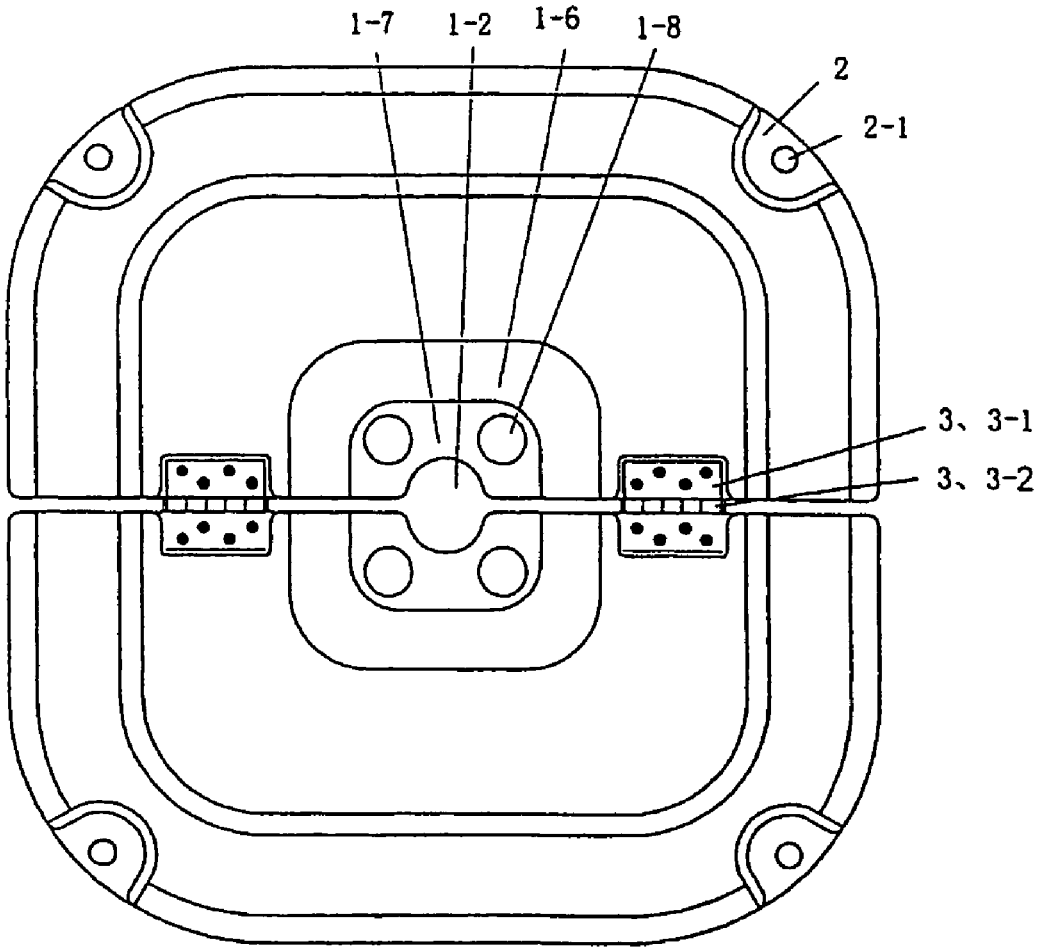
FIG. 4 is a rear-side view of FIG. 1.
Figure 5:
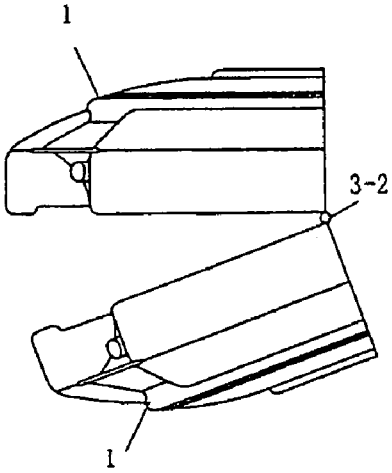
FIG. 5 is a view showing the folding process.
Figure 7:
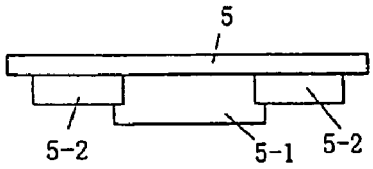
FIG. 7 is a view of lock plates in application examples.

Examples shown in FIGS. 1–5 are composed of two semi-bases 1 each having a cavity 1-5 connected by hinge 3, and the hinge 3 comprises two leaves 3-1 and axle 3-2 connecting the two leaves, the two leaves 3-1 each being connected to the bottom surface of the two semi-bases 1, the two semi-bases 1 being able to rotate with respect to each other (see FIG. 5).

On the joint face of the two semi-bases and on the central position are provided semi-cylindrical concaves, thereby forming holes 1-2 on the top surface for inserting a mast when the two semi-bases are pulled open. All the outer corners of the two semi-bases 1 are recessed inward, and on the recesses are provided slabs 2, and on the slabs 2 are provided bracket holes 2-1. Water discharge holes are disposed on the two semi-bases and located under the slabs 2 at corners, and at the ports of the water discharge holes are provided covers 4.

On the top surfaces of the two semi-bases 1 each are provided a protrusion 1-3. When the two bases 1 are pulled open, the protrusions 1-3 are connected on the top surface and around the mast hole 1-2 is formed a low lying 1-4, and on the low lying 1-4 at the top surface of each semi-base 1 are provided two water injection holes 1-1.

On the bottom surfaces of the two semi-bases 1 each are provided a protrusion 1-6. When the two bases are pulled open, the protrusions are connected on the bottom surface and around the mast hole is formed a low lying 1-7 on which a blind hole 1-8 is provided for positioning lock plates.

Examples of Application

Figure 6:
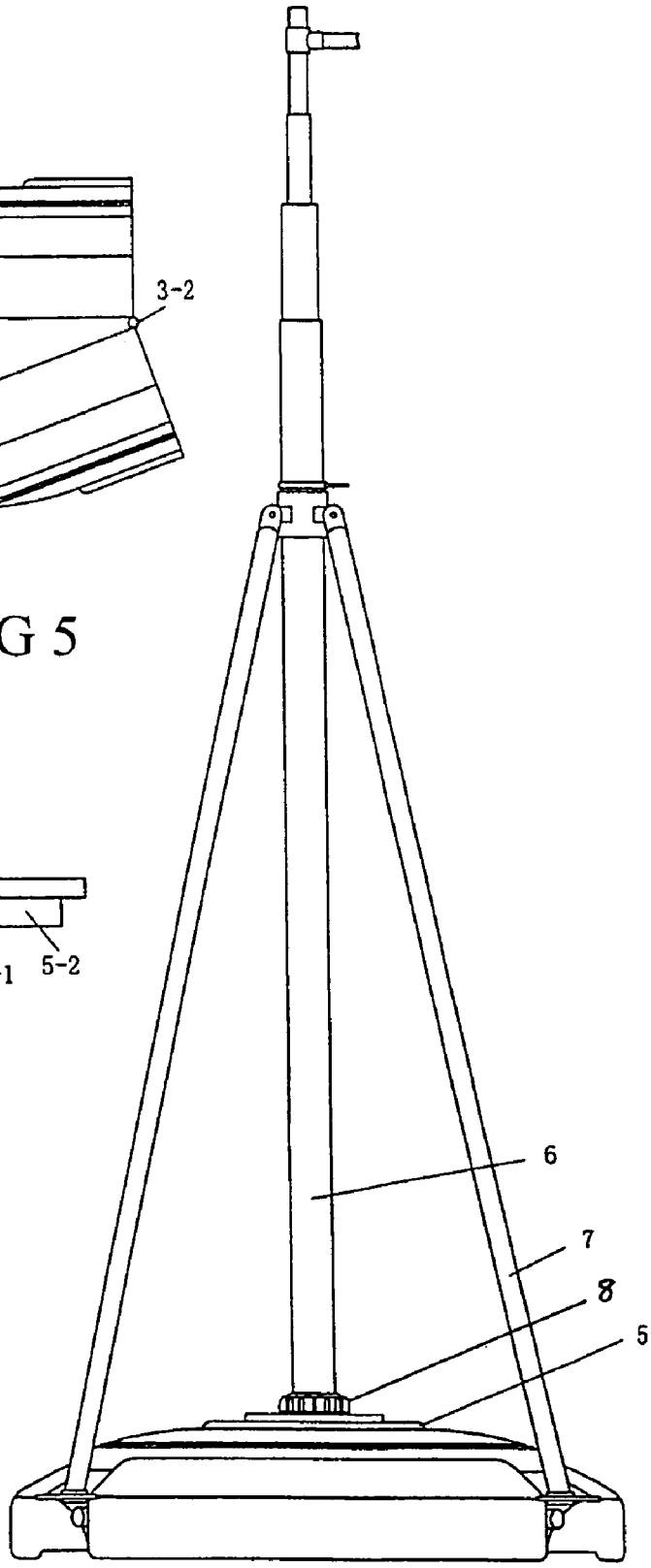
FIG. 6 is a view of application.

FIG. 6 shows examples of application. When the two bases 1 are pulled open, the base 1 is injected with water through the water injection hole 1-1. Lock plates 5 are disposed on the low lying 1-4 of the top surface of the two semi-bases and on the low lying 1-7 of the bottom surface thereof, on the bottom surface of the upper lock plate 5 is provided a central protrusion 5-1 corresponding to the mast hole 1-2 and a peripheral protrusion 5-2 corresponding to the water injection hole 1-1. The structure of the lower lock plate is the same as the upper lock plate, and on its top surface is provided a peripheral protrusion corresponding to the blind hole 1-8 for positioning the lock plate. The upper and lower lock plates are covered on the low lying of the corresponding top surface and bottom surface, and the protrusions are inserted in corresponding holes. In the upper and lower lock plates and mast hole 1-2 is inserted a hollow bolt 8 in which the mast 6 is inserted. Four brackets 7 are inserted into the bracket holes 2-1 of the slabs 2 respectively, and the nut of the hollow bolt 8 is screwed fast to lock the mast 6. The upper lock plate 5 covers the water injection hole 1-1. After use, the cover 4 of the water discharge hole is opened, and the water in the base 1 is discharged through the water discharge hole.

The invention claimed is:

1. A water injection rack base for a mast, characterized in that the base is formed of two semi-bases connected together by hinges, and each semi-bases having a cavity, at the top surfaces of the two semi-bases being provided one or two water injection holes, on the joint face of the two semi-bases and on the central position being provided semi-cylindrical concaves, thereby forming holes on the top surface for inserting a mast when the two semi-bases are pulled open.

2. The water injection rack base for a mast as claimed in claim 1, characterized in that said hinges are composed of two leaves and an axle hinging the two leaves, said two leaves being connected to the bottom surfaces of the two semi-bases respectively, and the two semi-bases being able to rotate with respect to each other through hinges.

3. The water injection rack base for a mast as claimed in claim 2, characterized in that all the outer corners of the two semi-bases are recessed inward, and on the recesses are provided slabs, and on the slabs of each semi-base are provided bracket holes.

4. The water injection rack base for a mast as claimed in claim 3, characterized in that on said semi-bases each are provided water discharge holes.

5. The water injection rack base for a mast as claimed in claim 4, characterized in that the water discharge holes of the various semi-bases are located under the slabs at corners, and at the ports of the water discharge holes are provided covers.

6. The water injection rack base for a mast as claimed in claim 5, characterized in that on the top surfaces of the two semi-bases each are provided a protrusion; when the two bases are pulled open, the protrusions are connected on the top surface and around the mast hole is formed a low lying on which the water injection hole is located.

7. The water injection rack base for a mast as claimed in claim 6, characterized in that on the bottom surfaces of the two semi-bases each are provided a protrusion; when the two bases are pulled open, the protrusions are connected on the bottom surface and around the mast hole is formed a low lying on which a blind hole is provided for positioning lock plates.

8. The water injection rack base for a mast as claimed in claim 7, characterized in that on the top surfaces of the semi-bases each are provided two water injection holes, and on the bottom surfaces thereof are provided two blind holes for positioning lock plates.

* * * * *